US009590333B1

(12) United States Patent
Chan

(10) Patent No.: US 9,590,333 B1
(45) Date of Patent: Mar. 7, 2017

(54) LOW PROFILE, INTEGRATED CIRCUIT TEST SOCKET

(71) Applicant: Incavo Otax, Inc., Alameda, CA (US)

(72) Inventor: Glenn Chan, Fremont, CA (US)

( * ) Notice: Subject to any disclaimer, the term of this patent is extended or adjusted under 35 U.S.C. 154(b) by 0 days.

(21) Appl. No.: 14/987,682

(22) Filed: Jan. 4, 2016

(51) Int. Cl.
*H01R 12/00* (2006.01)
*H01R 12/70* (2011.01)

(52) U.S. Cl.
CPC ..... *H01R 12/7076* (2013.01); *H01R 12/7082* (2013.01)

(58) Field of Classification Search
CPC ..... H01R 12/7076; H01R 12/7082; G01R 1/0433; G01R 1/06738; G01R 1/06722; G01R 1/0466
USPC ..... 439/68
See application file for complete search history.

(56) References Cited

U.S. PATENT DOCUMENTS 5,123,850 A 6/1992 Elder
5,489,854 A 2/1996 Buck
5,748,007 A 5/1998 Gaschke
5,807,104 A 9/1998 Ikeya
5,808,474 A 9/1998 Hively
5,932,891 A 8/1999 Higashi
6,046,597 A 4/2000 Barabi
6,152,744 A 11/2000 Maeda
6,559,665 B1 5/2003 Barabi
6,622,603 B1 9/2003 DiMaria
7,088,118 B2 * 8/2006 Liu ..... G01R 31/2889 324/756.03
7,108,535 B1 9/2006 Mingviriya
7,109,732 B2 * 9/2006 Alcoe ..... G01R 1/0483 324/750.25
7,199,599 B2 * 4/2007 Batara ..... G01R 1/0433 324/750.08
7,837,481 B1 * 11/2010 Mahoney ..... H01R 12/7076 439/66
8,269,516 B1 * 9/2012 Mardi ..... G01R 1/06722 324/754.08
8,506,307 B2 * 8/2013 Henry ..... G01R 1/06738 439/482
8,603,840 B2 * 12/2013 Matsuhashi ..... G01R 1/0466 257/E21.002
8,727,328 B2 5/2014 Lee
(Continued)

OTHER PUBLICATIONS

Aries Electronics, Inc., Data Sheet for "High-Frequency Interposer Socket", 3 pages, downloaded from the Internet Aug. 17, 2015.
(Continued)

*Primary Examiner* — Jean F Duverne
(74) *Attorney, Agent, or Firm* — Victor H. Okumoto

(57) ABSTRACT

A test socket has a housing structure that holds conductor pins which provide mechanical and electrical connections between vertically aligned contacts of a device under test and a PCB. The housing structure comprises a top housing and a bottom housing. The top housing has counterbore holes to receive and vertically constrain top ends of the conductor pins. The bottom housing comprises a sheet and an optionally attached supporting frame. The sheet has through-holes that are vertically aligned with the counterbore holes of the top housing to receive and vertically constrain bottom ends of the conductor pins when the top and bottom housings are attached to each other.

11 Claims, 8 Drawing Sheets

(56) References Cited

U.S. PATENT DOCUMENTS

| | | | |
|---|---|---|---|
| 2010/0197152 | A1 | 8/2010 | Naito |
| 2013/0069685 | A1 | 3/2013 | Swart |

OTHER PUBLICATIONS

Ostby Barton Pogo(R) Probes Catalog, 32 pages, copyright 2003.

* cited by examiner

LOW PROFILE, INTEGRATED CIRCUIT TEST SOCKET

FIELD OF THE INVENTION

The present invention generally relates to the testing of integrated circuit devices. In particular, it relates to a low profile, integrated circuit test socket.

BACKGROUND

A test socket electrically connects an Integrated Circuit (IC) device to a Printed Circuit Board (PCB) coupled to an IC tester. The IC tester provides electrical stimuli through the test socket to input contacts of the IC and receives electrical responses for analysis from output contacts of the IC through the test socket. As a result of the analysis, the IC tester may sort the IC into different categories, such as pass or fail, according to device specifications, or sort the IC into different grades, such as by measured response characteristics.

FIG. 1 illustrates a block diagram of a prior art test system for testing an IC 200, such as a Ball Grid Array (BGA) device, a Pin Grid Array (PGA) device, a Land Grid Array (LGA) device, and other devices having a plurality of electrical contacts organized in an array. An IC tester 400 is electrically connected to contacts on a PCB 300 through a cable 450. A test socket 100, which is adapted to receive the IC 200, is mounted on the PCB 300 to electrically connect the contacts on the PCB 300 to corresponding contacts on the IC 200.

The test socket 100 has conductor pins, such as spring-loaded probe pins (also known as "pogo pins"), which are contained within a body structure that is mounted to the PCB 300. Compression mounted test sockets with spring-loaded probe pins are commonly used for IC testing, because they allow easier removal, replacement, and repair of the test sockets.

FIG. 2 illustrates a housing structure 120 of the prior art test socket 100 which electrically connects contacts 230 of the IC 200 to corresponding contacts 330 of the PCB 300 when the IC 200 is received by the housing structure 120 and the housing structure 120 is mounted on the PCB 300. For examples of corresponding contacts, the contacts of the IC 200 that receive power are electrically connected to the contacts of the PCB 300 that provide power, the contacts of the IC 200 that are to be connected to ground are electrically connected to the contacts of the PCB 300 that are also connected to ground, the contacts of the IC 200 that receive input signals are electrically connected to the contacts of the PCB 300 that transmit those input signals, and the contacts of the IC 200 that transmit output signals are electrically connected to the contacts of the PCB 300 that receive those output signals.

In the example shown in FIG. 2, when the IC 200 is received in the housing structure 120, the IC's contacts 230 are vertically aligned with the PCB's contacts 330. The housing structure 120 comprises a top housing 140 and a bottom housing 150 for securing vertically held conductor pins 130 which make mechanical and electrical connections with corresponding pairs of the IC contacts 230 and the PCB contacts 330.

As one example of the conductor pin 130, a double-ended pogo pin is suitable for making a mechanical and electrical connection between aligned contacts of the IC 200 and PCB 300. FIGS. 3A and 3B respectively illustrate an example of a double-ended pogo pin 1300 in a non-compressed state and a compressed state. The double ended pogo pin 1300 has oppositely extending pin contacts 1310 and 1320 that are depressible within a barrel 1360 against internal compression spring 1350 which exerts a restoring force against plungers 1330 and 1340 of the pin contacts 1310 and 1320. To minimize transmission delays and cross talk between input/output contacts of the IC 200 and PCB 300, a miniature conductor pin that provides a low profile connection between corresponding contacts of the IC 200 and the PCB 300 may be useful. U.S. Pat. No. 6,046,597 describes an example of such a miniature conductor pin, as well as a prior art test socket such as described herein.

FIG. 4 illustrates a partial cross-sectional view of the prior art housing structure 120 of the test socket 100. As previously noted, the housing structure 120 comprises a top housing 140 and a bottom housing 150. To secure the conductor pins 130 in the housing structure 120, the top housing 140 has counterbore holes 145 which are sized to allow the top pin contacts (e.g., 1310) of the conductor pins 130 to pass through the top housing 140 to make mechanical and electrical connections with corresponding contacts of the IC 200, but prevents the barrels (e.g., 1360) of the conductor pins 130 from passing through. Likewise, the bottom housing 150 also has counterbore holes 155 which are sized to allow the bottom pin contacts (e.g., 1320) of the conductor pins 130 to pass through the bottom housing 150 to make mechanical and electrical connections with corresponding contacts of the PCB 300, but prevents the barrels (e.g., 1360) of the conductor pins 130 from passing through. Thus, when the top and bottom housings, 140 and 150, are attached to each other, the conductor pins 130 are vertically restrained by the attached top and bottom housings, 140 and 150.

As may be readily appreciated, the total height (or thickness) of the housing structure 120 is related to the length of the conductor pins which it is holding. As previously mentioned, shorter conductor pins may provide benefits for IC testing, such as minimizing transmission delays and cross-talk between input/output signals. To accommodate shorter conductor pins, a relatively thinner housing structure is generally used. However, although the total height of the housing structure 120 may be limited to accommodate the length of the conductor pins which it is holding, some flexibility is available in selecting the thicknesses of the top and bottom housings, 140 and 150, which add up to the total height. For illustrative purposes, in FIG. 4, the total height of the housing structure 120 is indicated by T1, the thickness of the top housing structure is indicated by T2, and the thickness of the bottom housing is indicated by T3.

Although FIG. 4 illustrates an example of a housing structure 120 which has approximately equal thicknesses for the top and bottom housings, 140 and 150, it may be desirable to have a thicker top housing 140, because a thin top housing 140 is more likely to bow or bend under pre-load forces from the conductor pins 130 when the test socket 100 is mounted on the PCB 300. However, a thicker top housing 140 means a thinner bottom housing 150, because the overall height or thickness of the housing structure 120 should be the same to properly accommodate the lengths of the conductor pins 130 which they are holding. The thickness of the bottom housing 150, however, is limited to a minimum thickness, indicated by T4, which is required to accommodate the counterbore holes 155 of the bottom housing 150. In light of these considerations, a range of commonly used top and bottom housing thickness ratios is believed to be between a 1 to 1 ratio (i.e., T2/T3=1, as shown in FIG. 4) and a 3 to 1 ratio (i.e., T2/T3=3.0).

As IC devices increasingly provide more functionality, the number of their Input/Output (I/O) contacts increase accordingly and the pitch between their I/O contacts may decrease accordingly. Also, as IC devices operate at increasingly higher speeds and/or bandwidths, test sockets which are used to test such IC devices preferably should have low profiles to minimize transmission delays through, and cross-talk between, I/O contacts of the IC devices. However, spring load forces from spring-loaded conductor pins create a strain on the socket's housing that may limit a minimal thickness for such housing. Accordingly, it is desirable to provide an improved test socket structure which has a low profile (i.e., low total height or thickness) and suitable structural integrity for high speed and/or high frequency testing of IC devices employing densely populated I/O contacts.

BRIEF SUMMARY

The embodiments of the invention are summarized by the claims that follow below.

DETAILED DESCRIPTION

In the following description, spatially relative terms—such as "top", "bottom", "beneath", "below", "lower", "above", "upper", "proximal", "distal", and the like—may be used to describe one element's or feature's relationship to another element or feature as illustrated in the figures. These spatially relative terms are intended to encompass different positions (i.e., locations) and orientations (i.e., rotational placements) of a device in use or operation in addition to the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. A device may be otherwise oriented (rotated 90 degrees or at other orientations) and the spatially relative descriptors used herein interpreted accordingly.

Figure 3A:
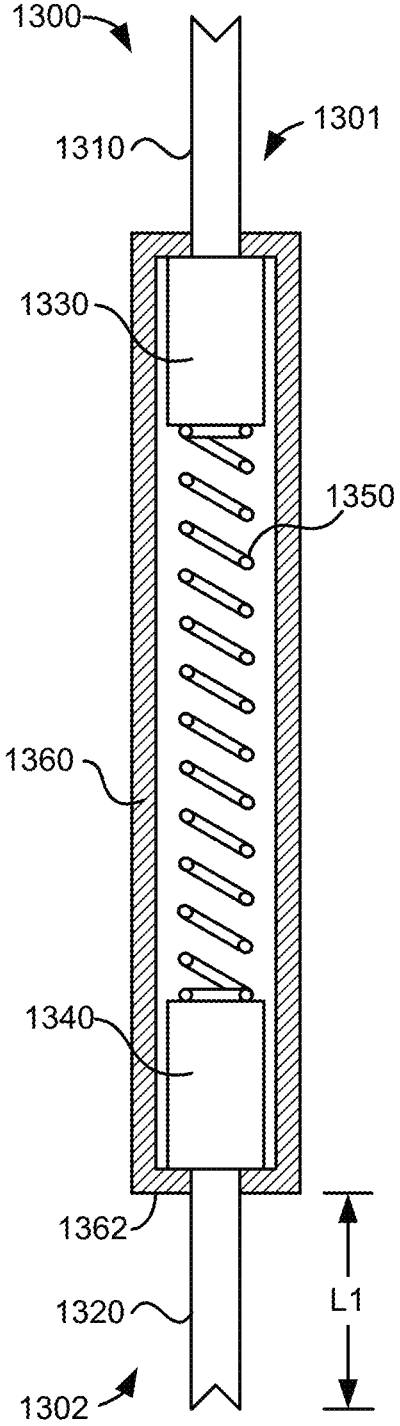
fig.3A prior art
FIG. 3A illustrates a cross-sectional side view of a prior art double-ended pogo pin in a non-compressed state.
Figure 3B:
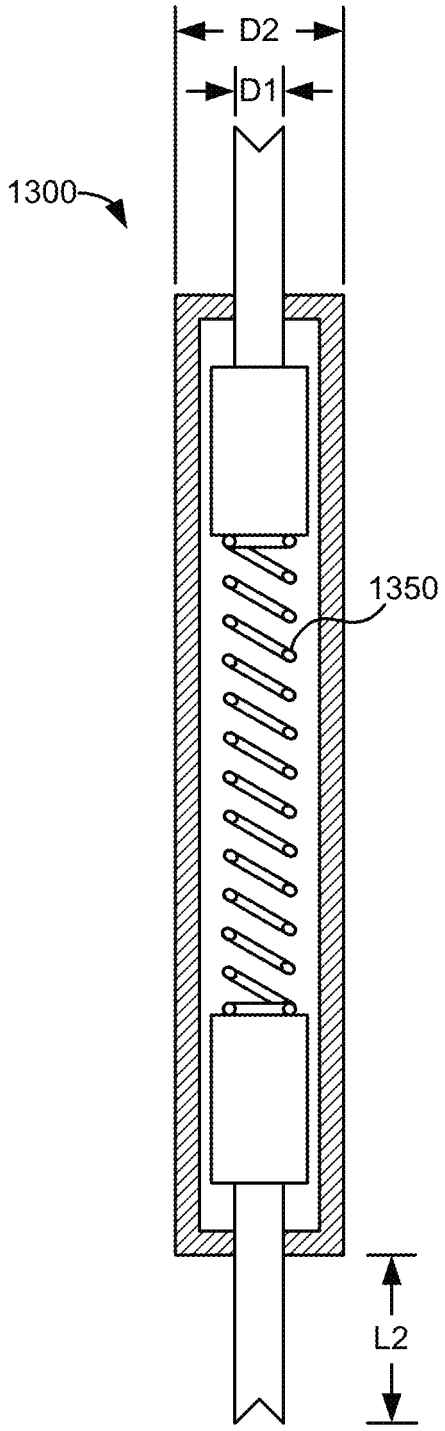
fig.3B prior art
FIG. 3B illustrates a cross-sectional side view of a prior art double-ended pogo pin in a compressed state.

In the following description, the conductor pins 130 are assumed to be the double-ended pogo pins 1300 shown in FIGS. 3A and 3B. However, it is to be appreciated that other types of conductor pins of various lengths and configurations may also be accommodated by the present invention. As examples, double-ended pogo pins with collars and single-ended pogo pins with and without collars may also be used with the present invention. It is to be further appreciated that descriptions of counterbore holes and through-holes in the following are to be adjusted as required to accommodate the barrel locations and other physical characteristics of such other types of conductor pins.

Figure 4:
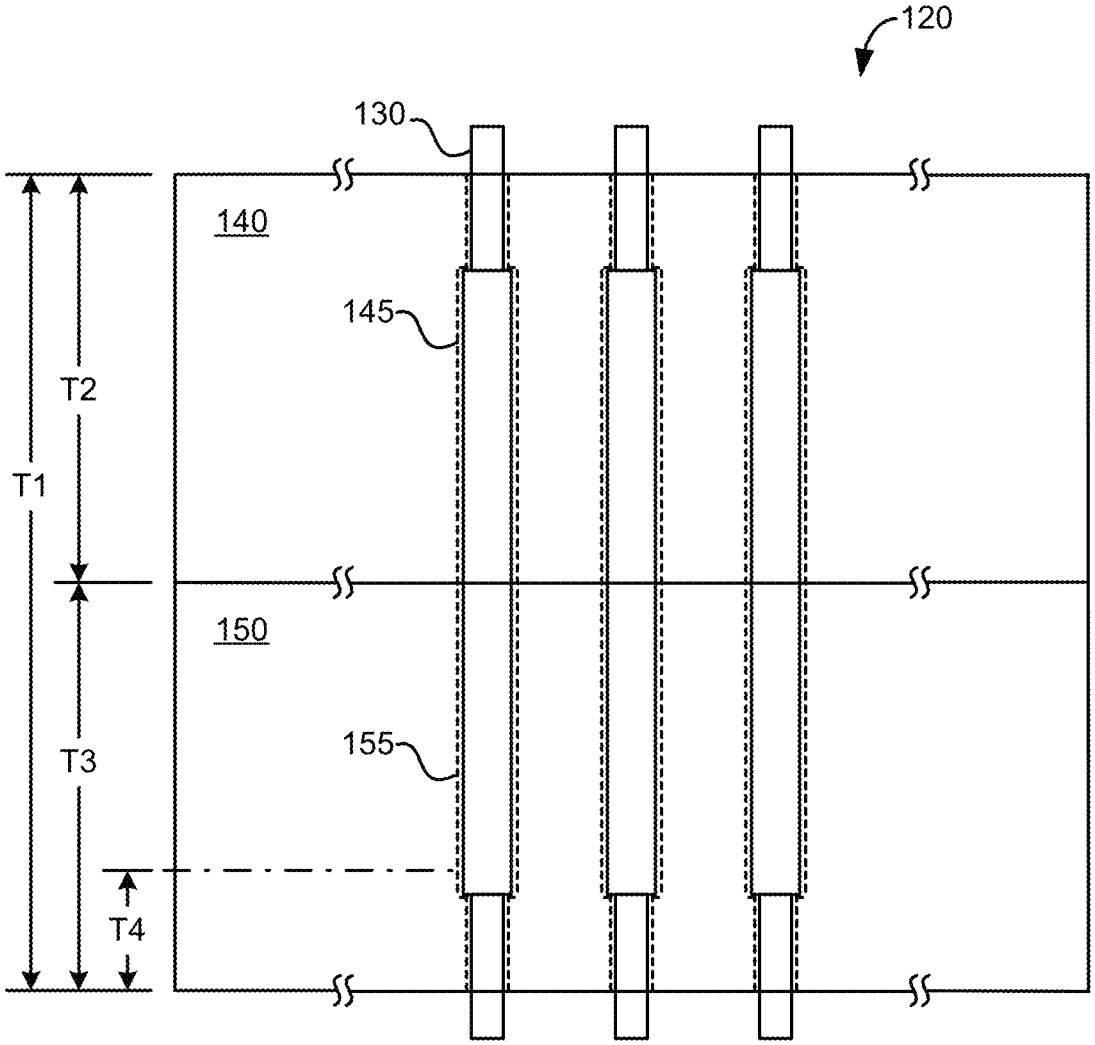
fig.4 prior art
FIG. 4 illustrates a cross-sectional partial side view of a prior art housing structure of a prior art test socket.
Figure 5:
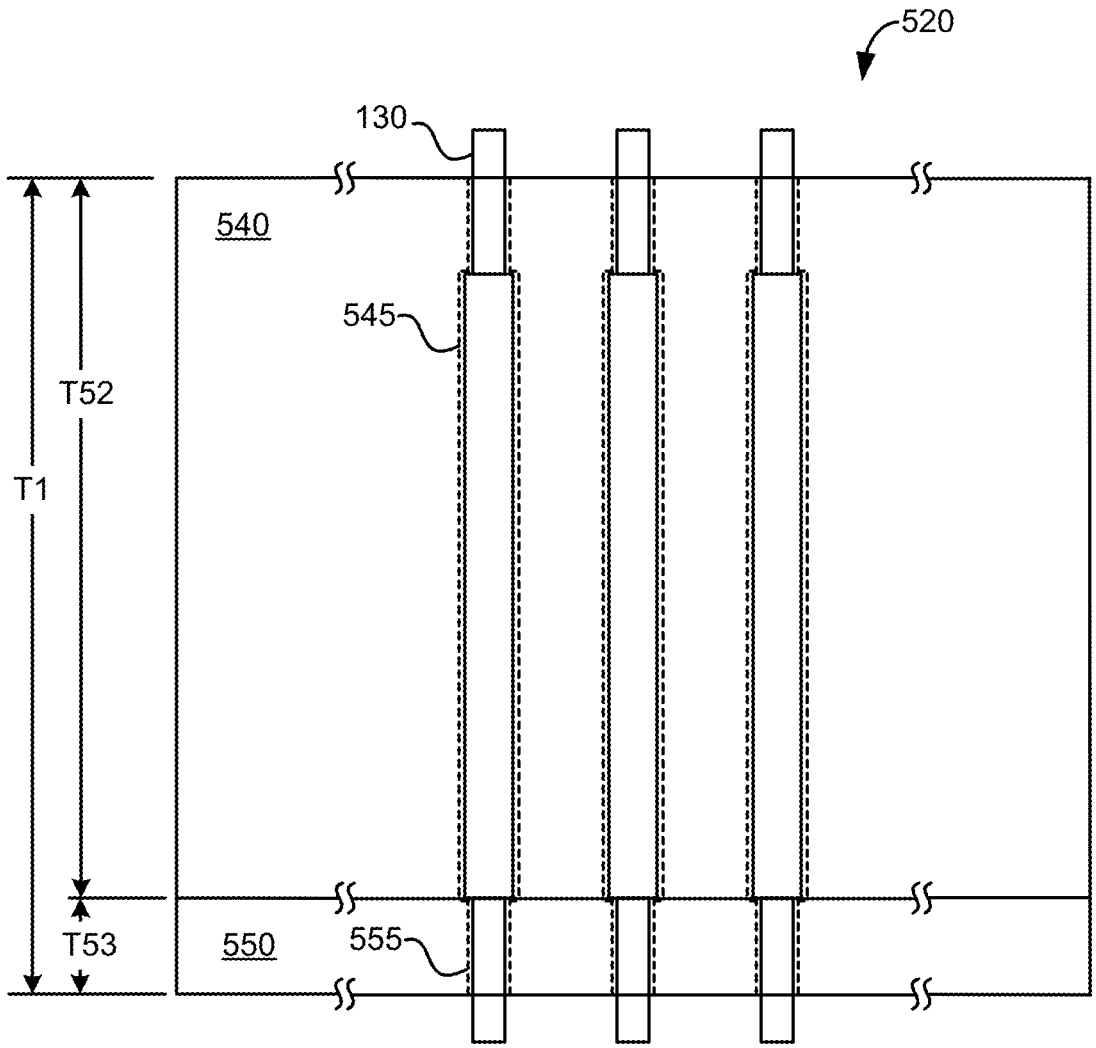
FIG. 5 illustrates a cross-sectional partial side view of an improved housing structure for a test socket.

FIG. 5 illustrates, as an example, a cross-sectional partial side view of an improved housing structure 520 for use in a low profile, IC test socket 600 of the present invention. The improved housing structure 520 has a top housing 540 and a bottom housing 550, which may be attached to each other by conventional means. Although the overall thicknesses of the improved housing structure 520 and the prior art housing structure 120 are the same (e.g., T1), the top housing 540 has a thickness T52 which is thicker than that of the prior art top housing 140 of FIG. 4 (e.g., T52>T2). The larger thickness makes the top housing 540 less likely to bow, than the prior art top housing 140, under pre-load forces from the conductor pins 130 when its test socket is mounted on a PCB. In contrast, the bottom housing 550 has a thickness T53 which is thinner than that of the prior art bottom housing 150 of FIG. 4 (e.g., T53<T3). Thus, although the overall height or thickness of the improved housing structure 520 may be the same as that of the prior art housing structure 120 (e.g., T1), the improved housing structure 520 is believed to be structurally superior due to its thicker top housing 540 (e.g., T52/T53>T2/T3). In particular, the ratio of the top and bottom housing thicknesses (T52/T53) is greater than 3.0 (or the upper end of the range for the prior art housing structure 120).

To vertically constrain the conductor pins 130 in the improved housing structure 520, the top housing 540 has counterbore holes 545 which are sized to allow the top pin contacts (e.g., 1310) of the conductor pins 130 to pass through the top housing 540 to make mechanical and electrical connections with corresponding contacts of the IC 200, but prevents the barrels (e.g., 1360) of the conductor pins 130 from passing through. In particular, each counterbore hole 545 comprises two concentric lumens that meet at a point inside the top housing 540. The smaller diameter lumen, which accommodates the diameter of the pin contact, extends from the top of the top housing 540 to the meeting point with the larger diameter lumen. Conversely, the larger diameter lumen, which accommodates the diameter of the barrel, extends from the bottom of the top housing 540 to the meeting point with the smaller diameter lumen. Preferably, the diameter of the larger lumens is sized so that the barrels of the conductor pins 130 are snugly held in place when the conductor pins 130 are inserted into the counterbore holes 545.

The bottom housing 550 has through-holes 555 which accommodate the conductor pins 130 being held by the top housing 540. The through-holes 555 are sized to allow bottom pin contacts (e.g., 1320) of the conductor pins 130 to pass through, but prevent barrels (e.g., 1360) of the conductor pins 130 from doing so (e.g., the diameter of the through-holes is greater than D1 and less than D2, wherein D1 is the diameter of the pin contact and D2 is the diameter of the barrel, as seen in FIG. 3B). Thus, the barrels of the conductor pins 130 are vertically restrained by a top surface of the bottom housing 550 in such case, as opposed to the prior art bottom housing 150 which uses counterbore holes 155 to vertically restrain the conductor pins 130.

Because the bottom housing 550 uses through-holes, instead of the counterbore holes 155 of the prior art bottom housing 150, the overall thickness of the bottom housing 550 may be thinner than that of the prior art bottom housing 150. In the prior art bottom housing 150, the counterbore holes 155 comprise concentric lumens which meet at a point in the bottom housing 150. The smaller diameter lumen, which accommodates the diameter of the pin contact, extends from the bottom of the bottom housing 150 to the meeting point with the larger diameter lumen. Conversely, the larger diameter lumen, which accommodates the diameter of the barrel, extends from the top of the top housing 150 to the meeting point with the smaller diameter lumen.

Thus, the length of the counterbore holes 155 is the sum of the lengths of the larger and smaller diameter lumens (e.g., length is greater than or equal to T4, as shown in FIG. 4). In contrast, the length of the through-holes is only the length of the smaller diameter lumen of the counterbore holes 155, which may be selected to be between L1 and L2 (see FIGS. 3A and 3B), the lengths of the contact pins 130 in their non-compressed and fully compressed configurations, when the barrels 1360 of the contact pins 130 abut the top surface of the bottom housing 550. The length of the through-holes need not include the length of the larger diameter lumen of the counterbore holes 155. Thus, the bottom housing 550 may be lower in height or thinner than the prior art bottom housing 150 by making the thickness of the bottom housing 550 to be less than or equal to the length of the smaller diameter lumen of the counterbore holes 155. In particular, when the top surface of the bottom housing 550 is used to vertically constrain the conductor pins 130, the thickness of the bottom housing 550 is preferably the length of the smaller diameter lumen of the counterbore holes 155. On the other hand, when the counterbore holes 545 of the top housing 540 are sized so as to firmly hold the conductor pins 130, then the thickness of the bottom housing 550 may be less than the length of the smaller diameter lumen of the counterbore holes 155 (e.g., thickness<T53).

Both top and bottom housings, 540 and 550, may be manufactured by using conventional injection molding techniques for a suitable material, such as a plastic material. As an alternative to injection molding the bottom housing 550, conventional machining techniques may be employed to fabricate the units. However, although machining may eliminate some tooling costs and actually provide more precise dimensions and better hole quality than injection molding, the time and cost to produce each unit may make this approach commercially less desirable. Three-dimensional (3D) printing is a relatively new fabrication technique that might be employed for fabricating the bottom housing 550. However, it may be difficult to fabricate units having dimensions within specification tolerances and acceptable hole quality using current 3D printing technology.

Figure 6:
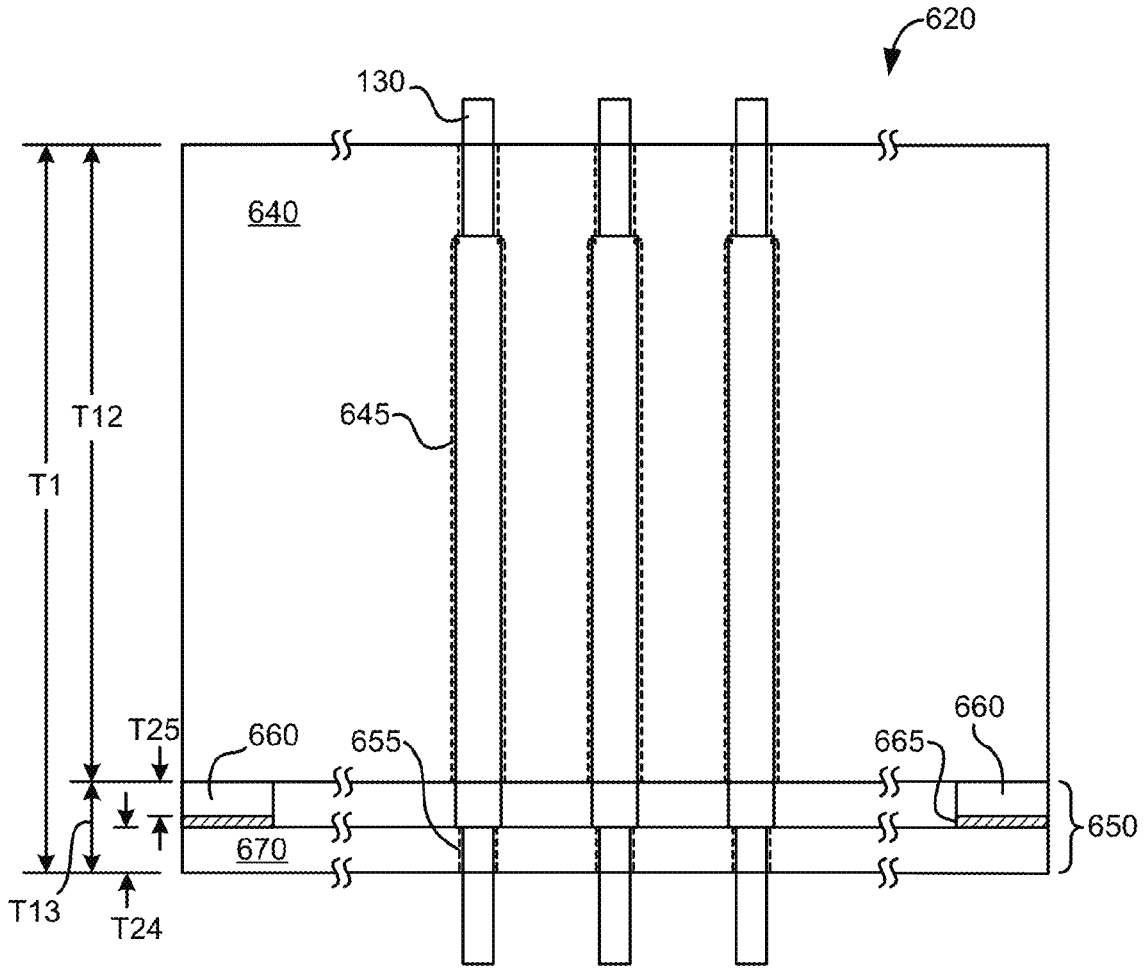
FIG. 6 illustrates a cross-sectional partial side view of an alternative improved housing structure for a test socket.

FIG. 6 illustrates, as an example, a cross-sectional partial side view of a alternative housing structure 620 for use in a low profile, IC test socket 600 of the present invention. A key feature of the alternative housing structure 620 is a modifiable portion that avoids the incurrence of relatively large tooling costs and long production lead-times. The alternative housing structure 620 includes a top housing 640 and a bottom housing 650. In the present example, the top housing 640 is generally constructed the same as the top housing 540 of the improved housing structure 520.

Figure 1:
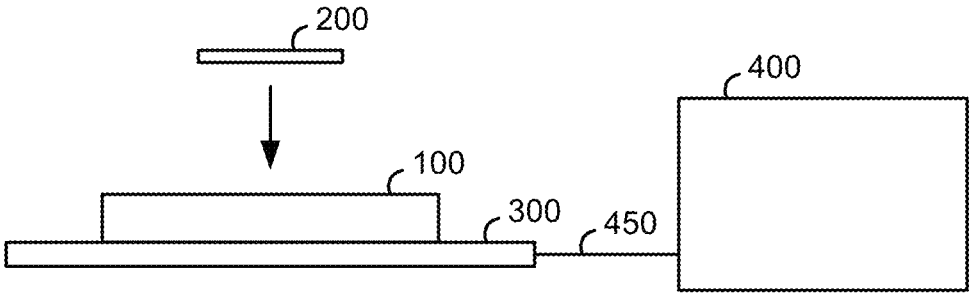
fig.1 prior art
FIG. 1 illustrates a schematic diagram of a prior art test system.
Figure 2:
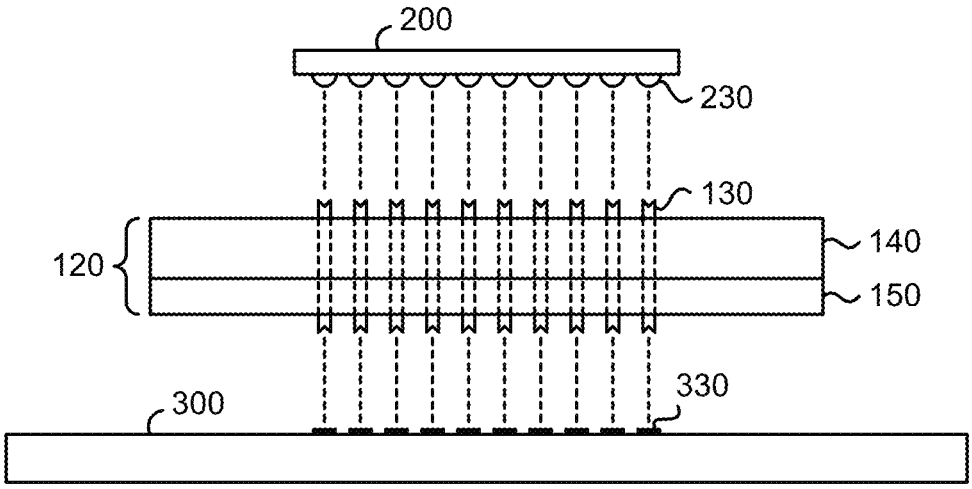
fig.2 prior art
FIG. 2 illustrates a schematic diagram of a prior art housing structure of a prior art test socket which electrically connects contacts of a device under test to corresponding contacts of a PCB.

In particular, the top housing 640 has a thickness T12 which is the same as the top housing 540 of the improved housing structure 520, but thicker than that of the prior art top housing 140 of FIGS. 2 and 4 (e.g., T12>T2). The larger thickness makes the top housing 640 less likely to bow, than the prior art top housing 140, under pre-load forces from the conductor pins 130 when its test socket is mounted on the PCB 300. In contrast, the bottom housing 650 has a thickness T13 which is the same as the bottom housing 550 of the improved housing structure 520, but thinner than that of the prior art bottom housing 150 of FIGS. 2 and 4 (e.g., T13<T3). Thus, although the overall height or thickness of the alternative housing structure 620 may be the same as that of the prior art housing structure 120 (e.g., T1), the alternative housing structure 620, like the improved housing structure 520, is believed to be structurally superior due to its thicker top housing 540.

To vertically constrain the conductor pins 130 in the alternative housing structure 620, the top housing 640 has counterbore holes 645 which are sized to allow the top pin contacts (e.g., 1310) of the conductor pins 130 to pass through the top housing 640 to make mechanical and electrical connections with corresponding contacts of the IC 200, but prevents the barrels (e.g., 1360) of the conductor pins 130 from passing through. In particular, each counterbore hole 645 comprises two concentric lumens that meet at a point inside the top housing 640. The smaller diameter lumen, which accommodates the diameter of the pin contact, extends from the top of the top housing 540 to the meeting point with the larger diameter lumen. Conversely, the larger diameter lumen, which accommodates the diameter of the barrel, extends from the bottom of the top housing 640 to the meeting point with the smaller diameter lumen. Preferably, the diameter of the larger lumens is sized so that the barrels of the conductor pins 130 are snugly held in place when the conductor pins 130 are inserted into the counterbore holes 645. For different types of conductor pins, such as those with collars, the counterbore holes 645 may be constructed differently as conventionally done to accommodate those different types of conductor pins.

The bottom housing 650 comprises a sheet 670 and a frame 660 which is attached by an adhesive 665 to a periphery of the sheet 670. The sheet 670 has through-holes 655 which accommodate the conductor pins 130 being held by the top housing 640. The through-holes 655 are sized to allow bottom pin contacts (e.g., 1320) of the conductor pins 130 to pass through, but prevent barrels (e.g., 1360) of the conductor pins 130 from doing so (e.g., the diameter of the through-holes is greater than D1 and less than D2, wherein D1 is the diameter of the pin contact and D2 is the diameter of the barrel, as seen in FIG. 3B). Thus, the conductor pins 130 are vertically restrained by the sheet 670, as opposed to the prior art bottom housing 150 which uses counterbore holes 155 to vertically restrain the conductor pins 130. Because the bottom housing 650 uses through-holes, instead of the counterbore holes 155 of the prior art bottom housing 150, the overall thickness of the bottom housing 650 may be thinner than that of the prior art bottom housing 150 for the same reasons as previously explained in reference to the improved housing structure 620.

The sheet 670 is preferably comprised of a polyimide film, such as Kapton® polyimide film manufactured by E. I. du Pont de Nemours and Company. Preferably, the sheet 670 has a maximum thickness of 0.5 millimeters (mm) to accommodate low profile conductor pins 130. In particular, the thickness of the sheet 670 is related to the bottom plunger length and travel of the conductor pins 130 when under compression (e.g., during test). A thickness greater than 0.5 mm would likely require one, or both of, a larger bottom plunger length and a counterbore, either of which would be undesirable. In addition to providing a thinner bottom housing, the use of through-holes 655 in the sheet 670 allows for easy fabrication of the sheet 670 using conventional precision hole punching or micro hole drilling techniques and equipment. For example, a high speed multi-head drilling technique may be employed wherein the drill set is programmed to a required pattern and automatically drills out the through-holes. In contrast, the fabrication of counterbore holes, such as in the prior bottom housing 150, generally requires a more complicated drilling procedure, resulting in higher fabrication costs.

Figure 10:
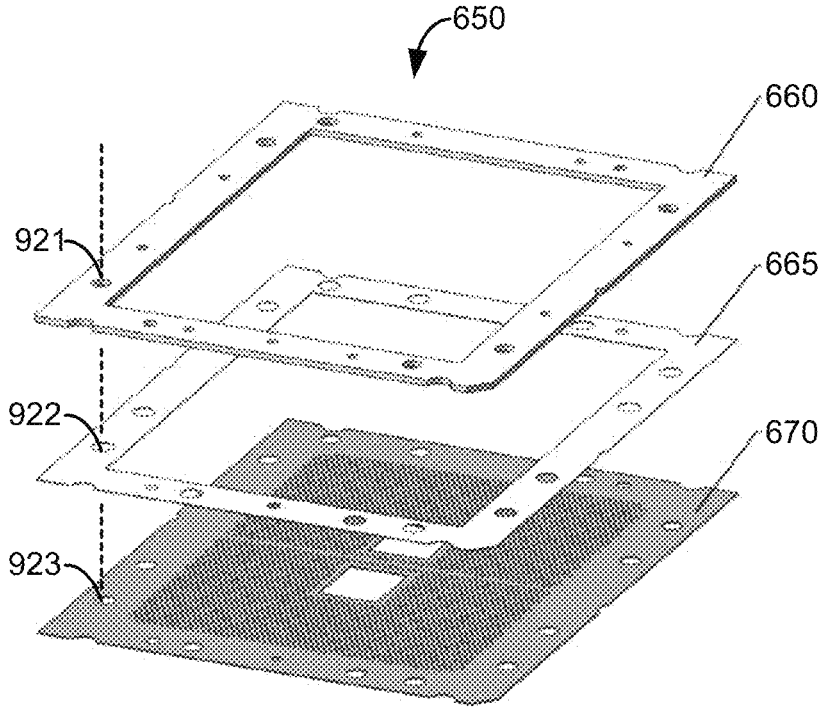
FIG. 10 illustrates an exploded view of a bottom housing of the alternative improved housing structure.

The frame 660 is preferably shaped as a picture frame so that when it is attached to the periphery of the sheet 670, it does not obstruct the through-holes 655 of the sheet 670. The adhesive 665 may be applied as a fluid or it may be an adhesive film that has a shape that resembles that of the frame 660, such as shown in FIG. 10. The frame 660 provides mechanical structure and support for the sheet 670 and allows ease of placement/removal during conductor pin replacement or cleaning. The frame 660 also aids in aligning the bottom housing 650 to the top housing 640 and removal/attachment of the bottom housing 650 to the top housing 640, so that assembly of the test socket 600 is made easier.

The sheet 670 may also be used, without the frame 660, as the bottom housing 550 of FIG. 5. In that case, it would be attached directly to the top housing 540 using the adhesive 665 or using similar attachment means as those used for attaching the frame 660 to the top housing 640. Although eliminating the frame 660 may provide a simpler construction, the benefits of using the frame 660, however, will not be available in such an approach.

In addition to providing a mechanically superior housing structure 620 relative to the prior art housing structure 120, use of the sheet 670 also provides added benefits of more precise dimensions, better hole quality, and substantially reduced tooling costs relative to injection molding techniques for fabricating the bottom housing 150, while providing competitive unit costs and reasonable unit production rates. Further, the construction of the bottom housing 650 provides similar dimension precision and hole quality as machined units, while providing significantly cheaper unit costs and significantly higher unit production rates.

Figure 11:
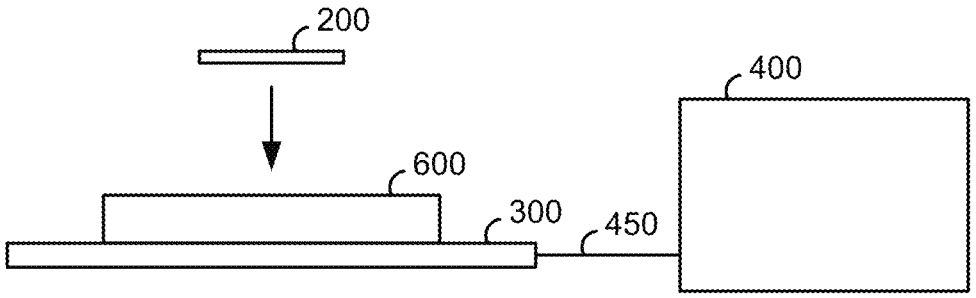
FIG. 11 illustrates a schematic diagram of a test system employing a test socket including the improved or alternative improved housing structure.

FIGS. 7-10 illustrate perspective views useful for a better understanding of the construction of a test socket 600 that includes the alternative improved housing structure 620, and FIG. 11 illustrates a block diagram of a test system for testing a IC 200 using the test socket 600. In the test system, an IC tester 400 is electrically connected to contacts on a PCB 300 through a cable 450 and the test socket 600, which is adapted to receive the IC 200, is mounted on the PCB 300 to electrically connect the contacts on the PCB 300 to corresponding contacts on the IC 200.

Figure 7:
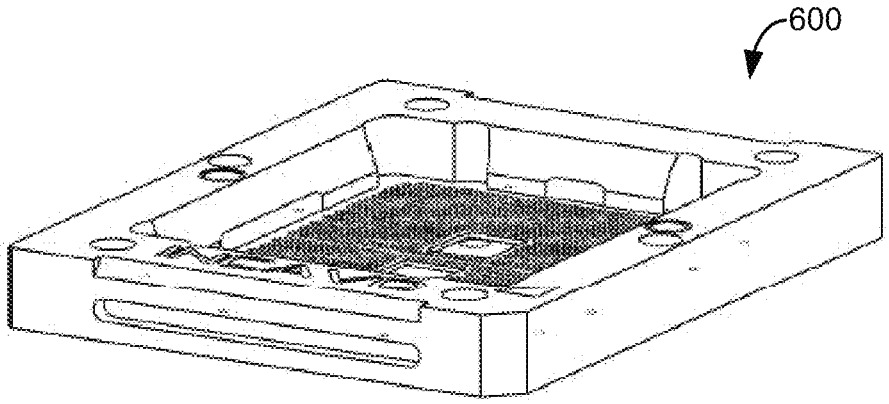
FIG. 7 illustrates a perspective view of a test socket including the alternative improved housing structure.
Figure 8:
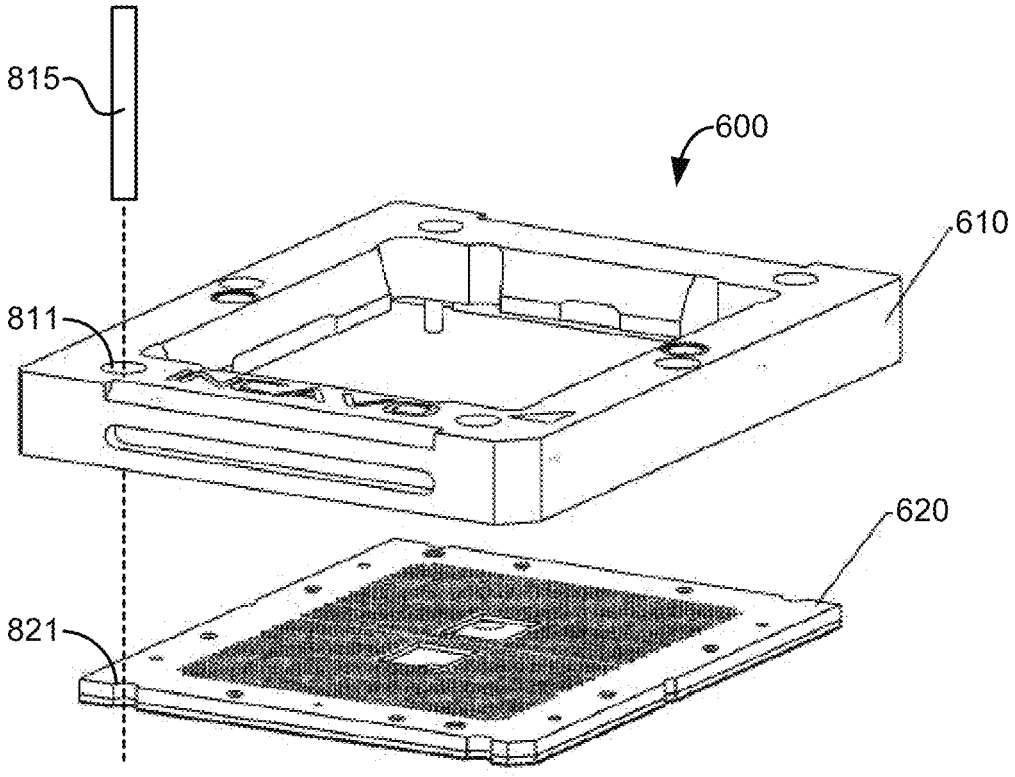
FIG. 8 illustrates an exploded view of the test socket including the alternative improved housing structure.

FIG. 7 illustrates a perspective view of the test socket 600, and FIG. 8 illustrates an exploded view of the test socket 600. The test socket 600 includes a socket frame 610, the alternative improved housing structure 620, and fixtures 815, such as screws, which are useful for affixing the test socket 600 to the PCB 300. As shown in FIG. 8, each fixture 815 passes through a hole 811 formed in the socket frame 610 and through a notch 821 formed on the bottom housing 620 and vertically aligned with the hole 811. As may be appreciated, the notch 821 is formed on each of the frame 660, adhesive film 665, and sheet 670, and is useful for alignment purposes.

Figure 9:
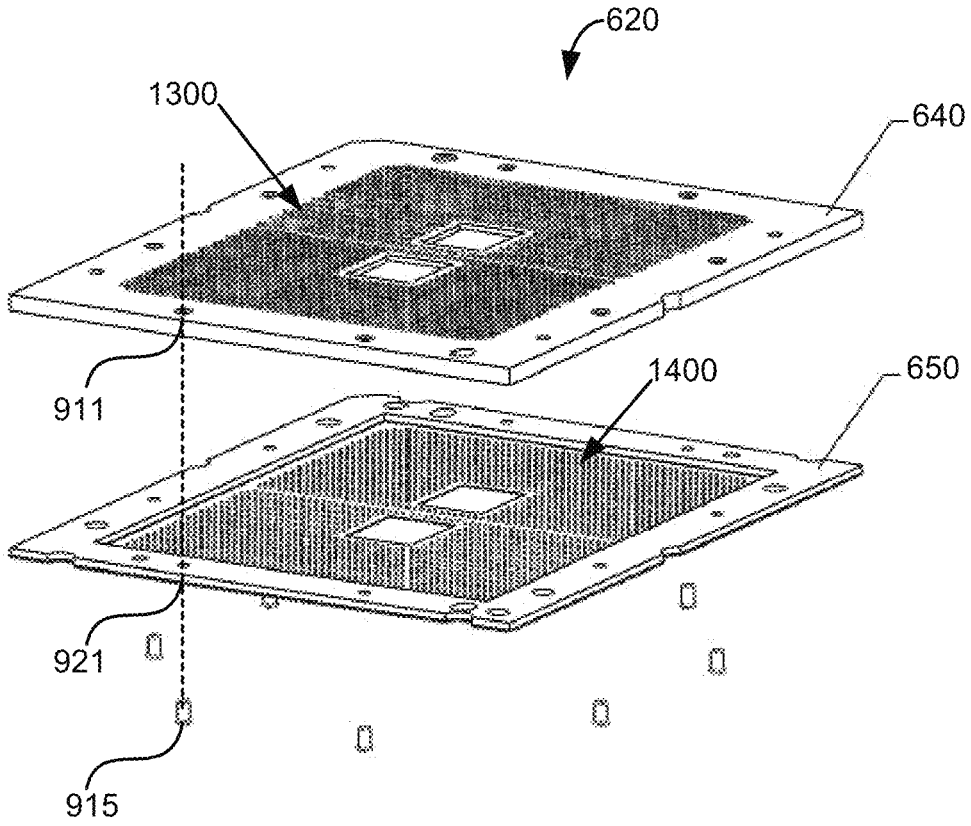
FIG. 9 illustrates an exploded view of the alternative improved housing structure.

FIG. 9 illustrates an exploded view of the alternative improved housing structure 620 to provide perspective views of the top housing 640 and bottom housing 650. As shown in the figure, there are a number of conductor pins 130 that are arranged in a two-dimensional array 1300 of conductor pins 130. Likewise, there are a number of corresponding through-holes 655 that are arranged in a two-dimensional array 1400 of through-holes 655 to receive the conductor pins 130 being held by the top housing 640. Fixtures 915, such as screws, are useful for affixing the top housing 640 to the bottom housing 650 through aligned holes, 911 and 921, respectively formed on the top and bottom housings, 640 and 650.

FIG. 10 illustrates an exploded view of the bottom housing 650 to provide perspective views of the frame 660, the adhesive film 665, and the sheet 670. As should be appreciated, each of the fixture holes 921 comprises aligned holes in the frame 660, adhesive film 665, and sheet 670, as shown in the figure.

Although the various aspects of the present invention have been described with respect to an embodiment, it will be understood that the invention is entitled to full protection within the full scope of the appended claims.

What is claimed is:

1. A test socket comprising:

a plurality of conductor pins;

a housing structure adapted to receive an integrated circuit device, the integrated circuit device having a first plurality of electrical contacts, the housing structure attachable to a printed circuit board having a second plurality of electrical contacts, the housing structure holding the plurality of conductor pins to provide mechanical and electrical connections between corresponding pairs of the first and second pluralities of electrical contacts when the integrated circuit device is received by the housing structure and the housing structure is attached to the printed circuit board;

wherein the housing structure comprises:

a top housing having a plurality of counterbore holes adapted to restrain top ends of the plurality of conductor pins; and a bottom housing, wherein the bottom housing comprises:

a sheet having a plurality of through-holes adapted to restrain bottom ends of the plurality of conductor pins.

2. The test socket according to claim 1, wherein the bottom housing further comprises:

a frame that is shaped and attached on one side to a periphery of the sheet and attached on an opposite side to a periphery of the top housing, so as not to obstruct the plurality of through-holes of the sheet and the plurality of counterbore holes of the top housing.

3. The test socket according to claim 2, wherein the frame is attached to the sheet by an adhesive material.

4. The test socket according to claim 2, wherein the frame is attached to the sheet by an adhesive film which is shaped to attach the frame to the sheet without obstructing the plurality of through-holes of the sheet and the plurality of counterbore holes of the top housing.

5. The test socket according to claim 1,
wherein each of the plurality of conductor pins is spring-loaded so that a length of the conductor pin adapts to a distance between an aligned pair of the first and second pluralities of contacts to make the mechanical and electrical connection between the aligned pair.

6. The test socket according to claim 5,
wherein a thickness of the bottom housing is greater than a length that the plurality of conductor pins is capable of extending beyond the top housing when in a fully compressed state.

7. The test socket according to claim 5,
wherein a thickness of the bottom housing is less than a length that the plurality of conductor pins is capable of extending beyond the top housing when in a non-compressed state.

8. The test socket according to claim 1,
wherein the sheet comprises a polyimide film.

9. The test socket according to claim 1,
wherein the sheet comprises a plastic material.

10. The test socket according to claim 1,
wherein a thickness of the sheet is less than or equal to 0.5 millimeters.

11. The test socket according to claim 1,
wherein a ratio of the thickness of the top housing to the thickness of the bottom housing is greater than 3 to 1.

* * * * *